United States Patent [19]

Germain

[11] 4,185,649

[45] Jan. 29, 1980

[54] ARRANGEMENT OF THE INPUT AND OUTPUT ENDS OF A METAL SHEET COOLING MACHINE

[75] Inventor: Alfred M. J. Germain, Grande Synthe, France

[73] Assignee: Union Siderurgique du Nord et de l'Est de la France, "USINOR", Paris, France

[21] Appl. No.: 974,016

[22] Filed: Dec. 28, 1978

[30] Foreign Application Priority Data

Dec. 30, 1977 [FR] France ..... 77 39835

[51] Int. Cl.[2] ..... B08B 3/04

[52] U.S. Cl. ..... 134/122 R; 134/83; 134/134; 266/102

[58] Field of Search ..... 266/102, 111-115; 134/64 R, 64 P, 83, 122 R, 122 P, 133-134, 154, 182-183, 199; 68/244; 29/116 AD; 100/93 RP, 153, 168-171

[56] References Cited

U.S. PATENT DOCUMENTS

| | | | |
|---|---|---|---|
| 2,546,538 | 3/1951 | Erhardt, Jr. | 266/112 |
| 2,708,943 | 5/1955 | Watson et al. | 134/133 X |
| 3,812,870 | 5/1974 | Geyken et al. | 134/122 R |
| 3,885,581 | 5/1975 | Dahan et al. | 134/122 R |

FOREIGN PATENT DOCUMENTS

| | | | |
|---|---|---|---|
| 262627 | 7/1913 | Fed. Rep. of Germany | 134/133 |
| 731543 | 6/1955 | United Kingdom | 134/64 R |

*Primary Examiner*—Robert L. Bleutge

*Attorney, Agent, or Firm*—Cushman, Darby & Cushman

[57] ABSTRACT

In order to achieve a seal which is as effective as possible, there are provided at the input and output ends of a metal sheet cooling machine flaps such as flap (input flap) which are journalled in a frame of the machine to turn about an axis X—X and are actuated by jacks. Supports carried by a rigid girder ensure that these flaps do not buckle under the effect of the pressure forces created in the machine.

12 Claims, 4 Drawing Figures

ARRANGEMENT OF THE INPUT AND OUTPUT ENDS OF A METAL SHEET COOLING MACHINE

DESCRIPTION

The present invention relates to machines for cooling metal sheets and in particular to a machine of the type disclosed in the U.S. Pat. No. 3,885,581, by the Applicant. Such a machine comprises a lower frame and an upper frame in which are mounted sets of rollers for driving and guiding the metal sheet and which define an enclosure in which a cooling fluid flows. In order that such a machine operate efficiently and under good conditions, the sealing of the enclosure must be as effective as possible so as to avoid escape of cooling fluid. These questions of sealing concern, on one hand, the part of the machine along the two lateral walls of the machine in the region of the junction between the upper and lower frames and, on the other hand, the input and output regions of the machine.

The invention concerns more particularly the arrangement of the cooling machine at its input and output ends, the problem to be solved residing in the arrangement of this input end and output end in such manner that, both in the absence of the sheet and during the passage of the sheet, the seal in the two end zones be as satisfactory as possible. Moreover, the means employed must be capable of withstanding without damage the forces to which they are subjected and they must be relatively simple and sturdy in construction.

According to the invention, there is provided an arrangement of the imput and output ends of a metal sheet cooling machine, comprising a lower frame and an upper frame carrying sets of guiding and/or driving rollers and each having lateral walls interconnected by a case defining an enclosure in which the cooling fluid can flow, wherein at each of its longitudinal ends the machine comprises at least one flap which is mounted to pivot about an axis which is transverse to the direction of travel of the metal sheet, an actuating mechanism for placing the flap in a selected angular position between two extreme positions one of which corresponds to the complete closure of the inlet or outlet end of the machine whereas the other corresponds to a withdrawn position of the flap allowing the passage of a sheet of maximum thickness.

According to other features of the invention:

a single flap journalled between the two lateral walls of one of the frames, preferably the upper frame, is provided at each end of the machine;

the flap has a box-like structure;

it comprises a convex surface facing the interior of the machine;

it is associated with at least one sealing element which extends throughout the width of the machine and is in contact with said convex surface;

at least one support means is provided which is in contact with an intermediate part of the flap facing outwardly of the machine and is intended to prevent its buckling;

the flap located at the output end of the machine comprises furthermore a deflector which makes an acute angle with the horizontal and is adapted to cause the flap to be raised automatically by the front or leading edge of a metal sheet issuing from the machine.

The invention will be described in more detail hereinafter with reference to the accompanying drawings which are given solely by way of example and in which.

Figure 1:
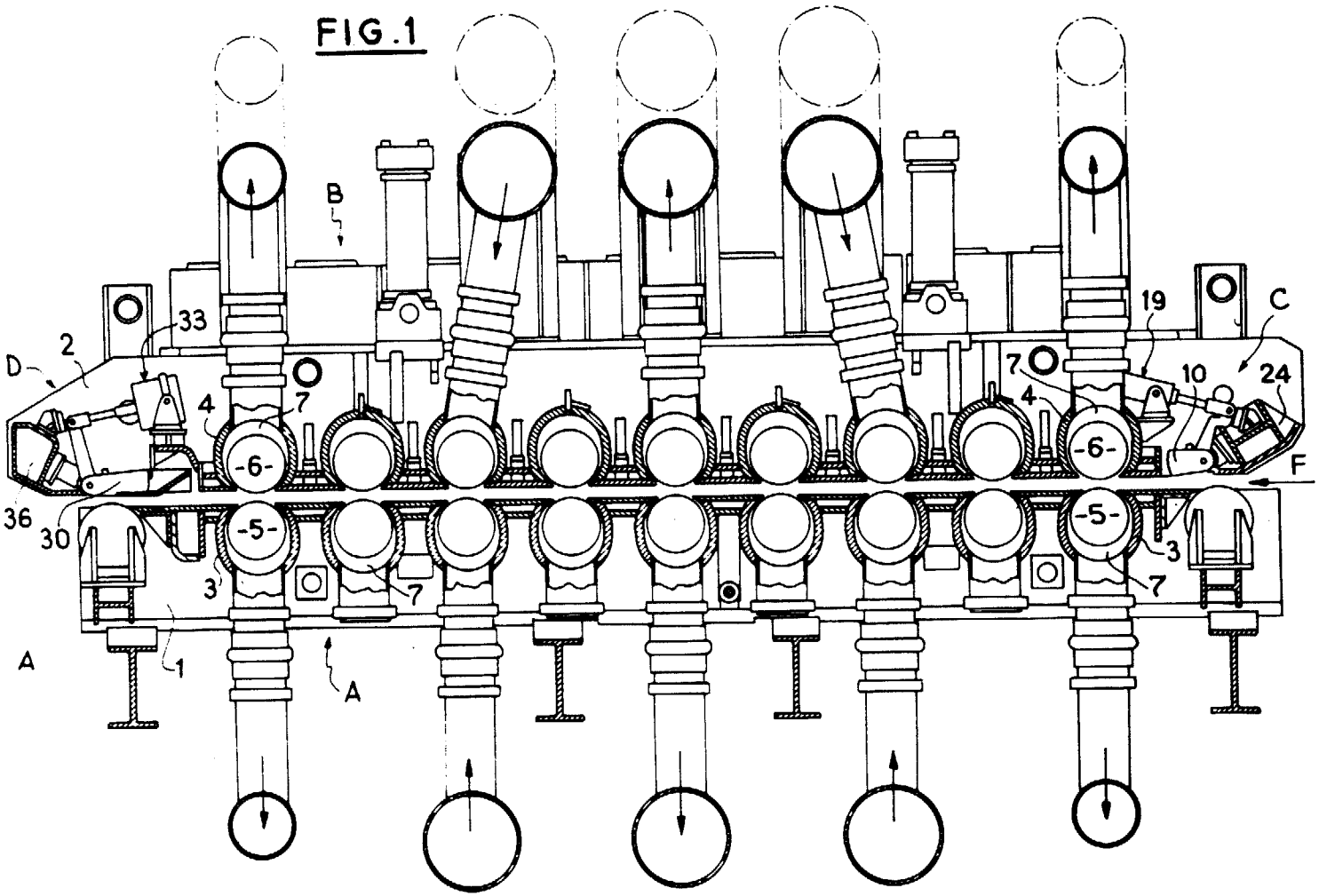
FIG. 1 is a longitudinal sectional view of a metal sheet cooling machine arranged in accordance with the invention.
Figure 2:
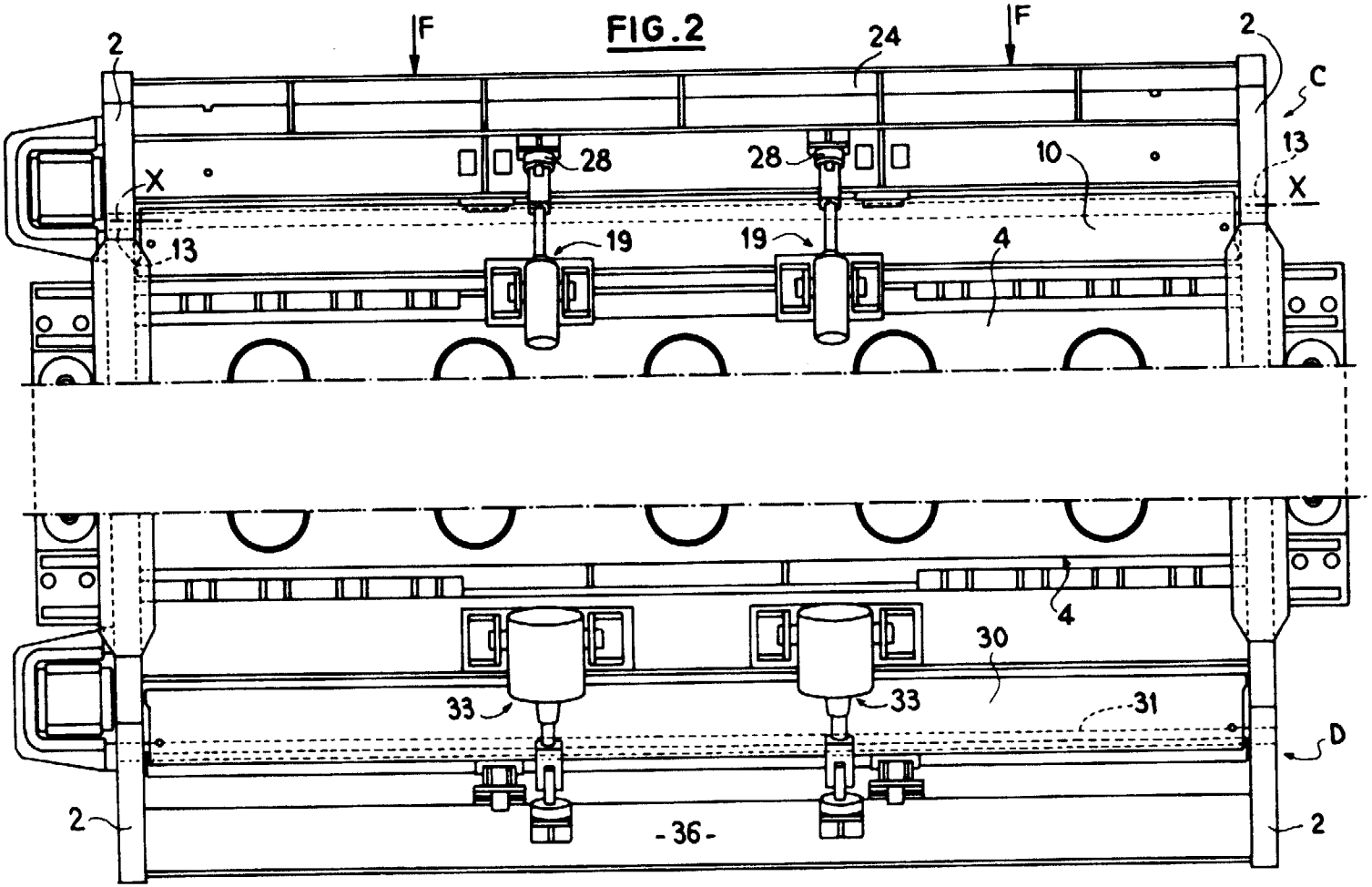
FIG. 2 is a partial plan view of the two ends of this machine.

FIGS. 1 and 2 show a cooling machine comprising a lower frame A and an upper frame B each of which is formed by two lateral walls constructed in the form of sufficiently thick plates and carrying respectively the reference 1, in respect of the lower frame, and the reference 2 in respect of the upper frame. These lateral walls are interconnected by cases 3, 4 which surround the rollers 5, 6 for driving and guiding the sheet and which define and enclosure 7 in which can flow a cooling fluid which is put in motion by supply and discharge devices which need not be described here in detail.

The seal along the two lateral walls of the machine is provided by means not shown in the drawing. As concerns the seal at the input and output ends of the machine, it is provided by devices C, D which will be described hereinafter.

Figure 3:
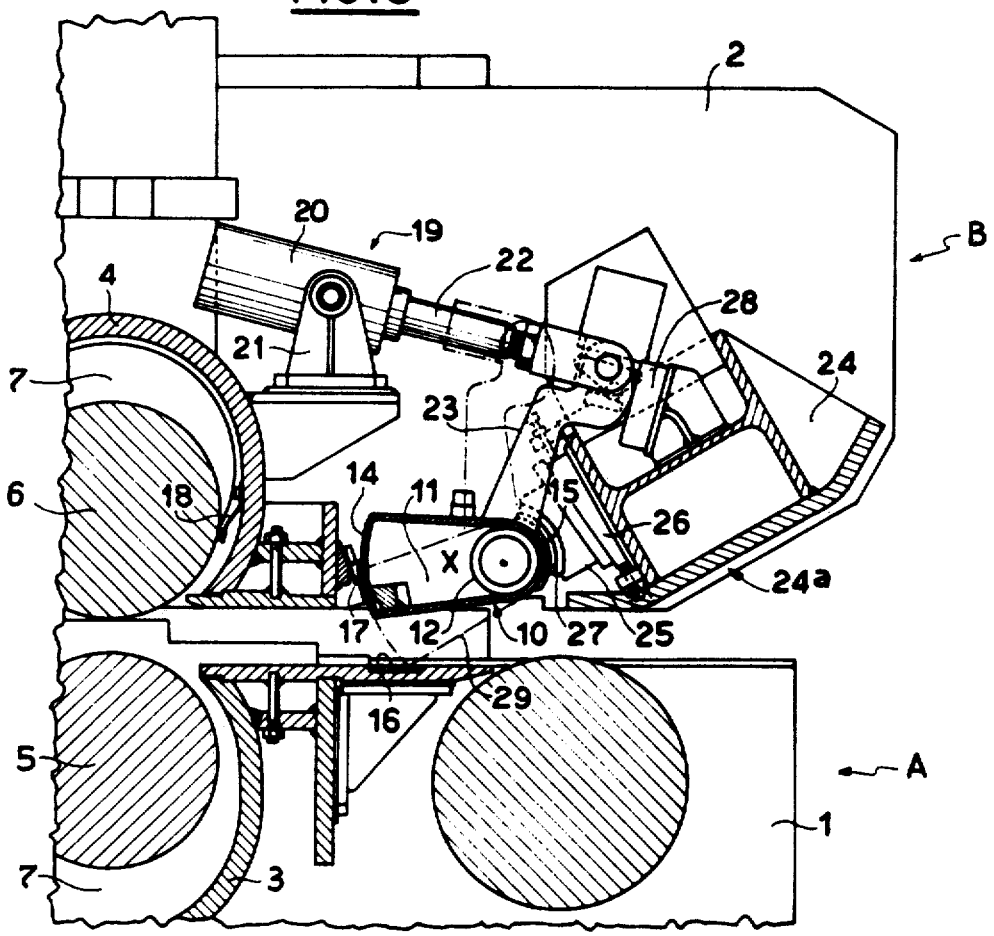
FIG. 3 is a longitudinal sectional view of the input end part of the machine.

The input end of the machine which corresponds to the upper part of FIG. 2 (the metal sheet travelling in the direction of arrows F) is provided mainly with a flap 10 which is formed in the presently described embodiment by a box-structure 11 rigid with a longitudinal tube 12 which is journalled in two bearings 13 provided in the lateral walls 2 of the upper frame to rotate about an axis X—X (FIG. 3). Preferably, these bearings comprise an eccentric device of known type which enables the parallelism of the axis of the flap relative to the roller table and to the adjacent elements of the frame of the machine to be adjusted. The flap 10 has a box structure having a cross-sectional shape in the form of a curvilinear triangle, the face 14 of this box structure facing the machine having a circular convex cross-sectional shape centered on the pivot axis X—X of the flap. The opposite part 15 of the box structure which surrounds the tube 12 is also cylindrical and centered on the same axis X—X but of smaller radius. This box structure may be connected to a cooling fluid circuit.

The lower frame carries a support plate 16 or plating of relatively soft metal, for example bronze, on which the flap bears in the closed position shown in dot-dash lines in FIG. 3. A sealing element 17 having a certain elasticity is carried by the upper frame and cooperates with the convex face 14 of the flap. Another sealing element 18 is also provided between the upper roller 6 which is the closest to the inlet of the machine and the adjacent case.

The mechanism for actuating the flap comprises in the presently-described embodiment two pneumatically controlled jacks 19 whose cylinder 20 is mounted to pivot about a horizontal axis on a bracket 21 rigid with the upper frame and whose piston rod 22 is connected to an arm 23 rigid with the box structure.

According to an important feature of the invention, there is provided between the two lateral walls of the upper frame a girder or beam 24 which carries two support means 25 which are located respectively at one third and at two thirds of the length of the flap and are adapted to preclude the buckling of the latter. These support means are adjustable by a wedge mechanism 26 and have a lining 27 of antifriction material, for example bronze.

The girder 24 carries also an abutment 28 which determines the end-of-travel of the pneumatically controlled jacks. The girder 24 defines a deflector 24a at the input end of the machine.

Note that, in the closing position of the flap, the angle made by the lower face 29 of this flap and the horizontal plane is relatively small, for example around 30° to 40°, so as to result in the automatic raising of the falp by the leading edge of an incident metal sheet, in the event that the actuating mechanism does not operate.

Figure 4:
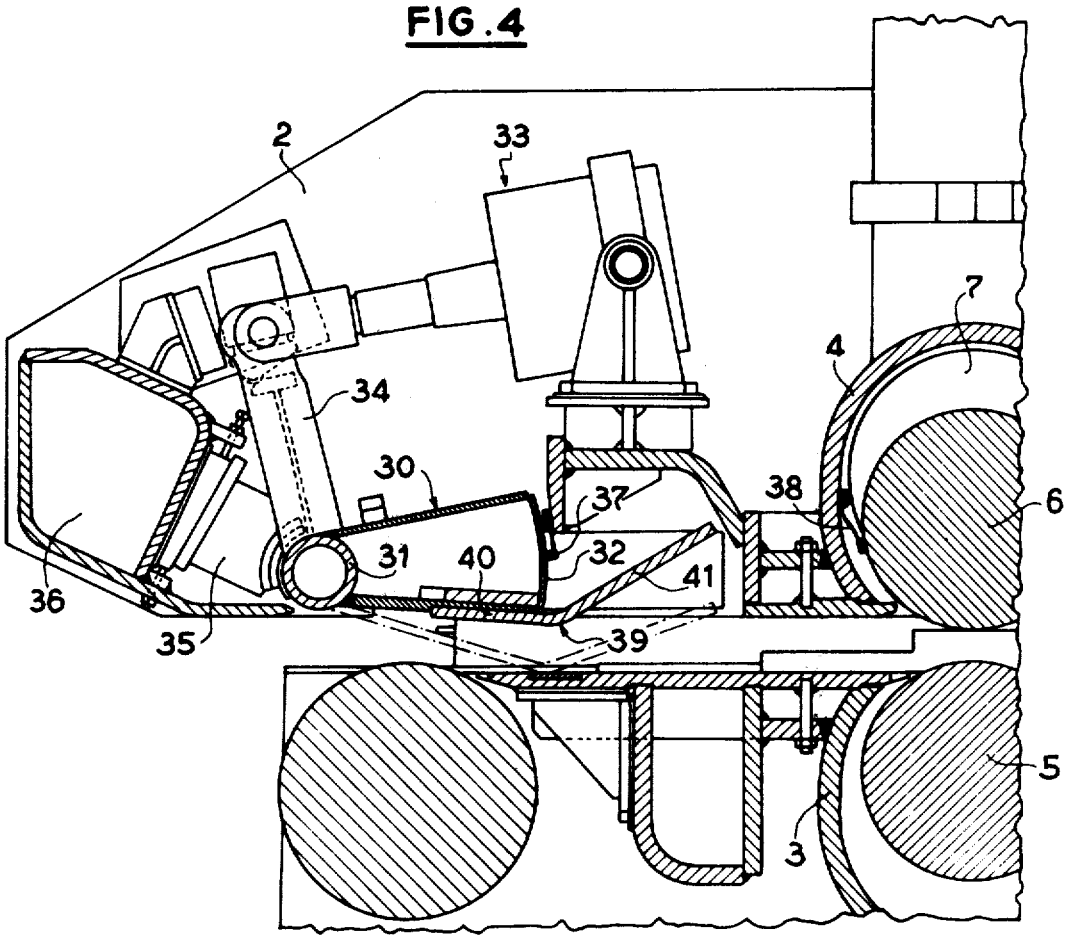
FIG. 4 is a view similar to FIG. 3 of the output end part of the machine.

The arrangement of the output end of the machine is very similar to that just described and there is provided (FIG. 4) a flap 30 having a box-structure and comprising a cylindrical tube 31 which is journalled in the two lateral plates of the upper frame and a convex face 32 which faces toward the interior of the machine. Also provided is a similar actuating mechanism including pneumatically controlled jacks 33 and arms 34, and support means 35 carried by a girder or beam 36 which extends between the two lateral plates 2. The same sealing elements 37, 38 are provided between the flap and the output face of the machine and between the case and the end rollers of the machine.

According to a further feature of the invention, the output flap carries a deflector 39 formed by a metal sheet having a flange 40 for fixing the deflector to the flap and a flange 41 which, in the closing position of the flap shown in dot-dash lines in FIG. 3, makes with the horizontal a small angle of around for example 30° to 40°. This deflector performs the same function as the lower face of the inlet flap with respect to an incident metal sheet so as to cause the flap to rise in the event that the actuating mechanism 33 does not operate.

The arrangements just described operate in the following manner:

When the machine, and more precisely the enclosure 7, is filled with liquid, the input flap 10 and output flap 30 are in the lower position and provide a seal for the input orifice and output orifice of the machine in coming into contact with the platings 16. The orientation of these flaps is such that, under the effect of the pressure prevailing in the machine, they are in equilibrium and are subjected to no opening or closing force. When a metal sheet must travel through the cooling machine, the jacks actuating the input flap are automatically or manually operated, which causes the flap to rise a sufficient extent to allow the passage of the sheet, with however a slight clearance of around a few millimeters between the lower edge of the flap and this sheet. The position of the flap is of course determined in accordance with the thickness of the sheet being treated. At the outlet end of the machine, the procedure is identical and the flap 30 is brought to the open position a few moments before the sheet emerges from the machine.

As mentioned before, if the actuating mechanism does not operate, the inclinations of the lower faces of the input flap and of the deflector rigid with the output flap are such that the passage of the sheet automatically raises the two flaps.

Note also that, owing to the presence of the girders 24 and 36 and of the intermediate support means 25 and 35, and owing to the box-structure of the flaps, any buckling of the latter under the pressure forces is avoided.

Moreover, the regulating means provided for the support means and for the bearings in which the flaps are journalled provide a particularly precise assembly which is consequently particularly effective.

The importance of the sealing elements 18, 38 provided between the case and the rollers located close to the input and output ends of the machine must also be stressed. These sealing elements avoid a phenomenon of an unpriming of the machine by the entry of air in the zone located between the rollers and the upper part of the adjacent enclosure which is preferably connected to cooling liquid discharge pipes.

The two arrangements just described of the input and output parts of the machine thus solve the problem mentioned in the preamble of this description, while they are simple and sturdy in construction and consequently particularly reliable in operation.

It must be understood that modifications may be made, in particular as concerns the acuating mechanism, the type of sealing elements employed, and other elements, without departing from the scope of the invention define by the claims.

Having now described my invention what I claim as new and desire to secure by Letters Patent is:

1. An arrangement for a machine for cooling a metal sheet, which machine comprises a lower frame and an upper frame, sets of rollers respectively carried by the frames for rollingly supporting the sheet by contact with upper and lower faces of the sheet, each frame comprising lateral walls which extend longitudinally of the machine and are spaced apart transversely of the machine, and a case interconnecting the lateral walls and defining an enclosure, and means for supplying a cooling fluid to said enclosure, the cases of the upper and lower frames defining an input longitudinal end and an output longitudinal end of the machine, said arrangement comprising at each of said longitudinal ends at least one flap mounted on the machine to be pivotable about an axis which extends transversely of the machine and transversely of the direction of travel of the sheet through the machine, between two extreme positions one of which positions corresponds to the complete closure of the corresponding end of the machine whereas the other position corresponds to a withdrawn position of the flap allowing the passage of a sheet, of maximum thickness and an actuating mechanism combined with each flap for putting the flap in a selected position between said two positions of the flap.

2. An arrangement as claimed in claim 1, comprising, at each end of the machine, a single flap which is journalled between the two lateral walls of one of the frames.

3. An arrangement as claimed in claim 1, wherein the flap has a box-structure.

4. An arrangement as claimed in claim 3, wherein the flap comprises a tube which is journalled at its ends in the frame and is rigid with the box-structure.

5. An arrangement as claimed in claim 1, wherein the flap has a convex face facing the interior of the machine between said two longitudinal ends.

6. An arrangement as claimed in claim 5, comprising at least one sealing element extending transversely of the machine throughout the space between the lateral walls and in contact with said convex face of the flap.

7. An arrangement as claimed in any one of the claims 1 to 6, comprising at least one support means in contact with an intermediate part of the flap which faces outwardly of the machine, for precluding the buckling of the flap.

8. An arrangement as claimed in claim 7, comprising a rigid girder which extends between the two lateral walls of the frame and carries the support means.

9. An arrangement as claimed in claim 7, wherein the support means is adjustable in position.

10. An arrangement as claimed in any one of the claims 1 to 6, wherein the flap located at the input end of the machine has a lower face which is upwardly inclined outwardly of the machine and makes an acute angle with the horizontal in said complete closure position of the flap.

11. An arrangement as claimed in any one of the claims 1 to 6, wherein the flap located at the output end of the machine further comprises a deflector which is upwardly inclined inwardly of the machine and makes an acute angle with the horizontal so as to cause the flap to be automatically raised by the leading edge of the metal sheet emerging from the machine.

12. An arrangement as claimed in any one of the claims 1 to 6, comprising a sealing element interposed between and in sealing contact with each end roller of the rollers carried by the upper frame and the adjacent case of the machine.

* * * * *